US005318263A

United States Patent [19]

Bischoff et al.

[11] Patent Number: 5,318,263

[45] Date of Patent: Jun. 7, 1994

[54] WALL-MOUNT ROD FOR HAND SHOWER

[75] Inventors: Bernd Bischoff, Iserlohn; Detleff Hochstein, Hemer, both of Fed. Rep. of Germany

[73] Assignee: Friedrich Grohe Aktiengesellschaft, Hemer, Fed. Rep. of Germany

[21] Appl. No.: 913,308

[22] Filed: Jul. 14, 1992

[30] Foreign Application Priority Data

Jul. 23, 1991 [DE] Fed. Rep. of Germany ..... 4124353

[51] Int. Cl.[5] ..... A47H 1/14

[52] U.S. Cl. ..... 248/220.2; 248/221.4; 248/251

[58] Field of Search ..... 248/251, 220.2, 221.4, 248/547, 261; 411/52, 53

[56] References Cited

U.S. PATENT DOCUMENTS

| | | | |
|---|---|---|---|
| 2,336,153 | 12/1943 | Ryder | 411/352 |
| 2,542,941 | 2/1951 | Post | 248/251 X |
| 3,075,735 | 1/1963 | Skinner | 248/251 |
| 3,098,240 | 7/1963 | Fleenor | 248/251 X |
| 4,523,734 | 6/1985 | Grohe | 248/251 |

FOREIGN PATENT DOCUMENTS

| | | |
|---|---|---|
| 643115 | 5/1964 | Belgium . |
| 0105115 | 4/1984 | European Pat. Off. . |
| 6922086 | 6/1969 | Fed. Rep. of Germany . |
| 2844191 | 3/1980 | Fed. Rep. of Germany . |
| 8801060 | 4/1988 | Fed. Rep. of Germany . |
| 8909996 | 12/1989 | Fed. Rep. of Germany . |

OTHER PUBLICATIONS

European Search Report for Application EP 92 11 2041, together with translation, listing above publications.

*Primary Examiner*—Eugenia Jones
*Assistant Examiner*—Kenneth E. Peterson
*Attorney, Agent, or Firm*—Herbert Dubno; Andrew Wilford

[57] ABSTRACT

A rod assembly for mounting a hand shower on a wall has an elongated rod formed at each end with a transversely throughgoing and laterally closed hole and respective holder bodies each formed with a seat in which the respective end of the rod is complementarily engageable. Each body is formed with a passage alignable with the hole of the respective rod end when same is fitted thereto. Respective screws engageable through the aligned holes and passages of the rod and bodies with the wall secure the rod to the bodies and the bodies to the wall.

6 Claims, 4 Drawing Sheets

WALL-MOUNT ROD FOR HAND SHOWER

FIELD OF THE INVENTION

The present invention relates to a hand shower. More particularly this invention concerns a wall-mount rod for a hand shower.

BACKGROUND OF THE INVENTION

It is standard to mount a hand shower on a vertical wall-mounted rod for stationary use of the hand shower. Normally a releasable clamp is provided for moving the hand shower up and down on the rod to adjust its vertical position.

German utility model 6,922,086 published 26 Feb. 1970 describes such an arrangement where the rod is tubular and is formed at each end with an L-section notch. Two brackets each have a seat in which the respective rod end is engageable with a pin projecting radially into the seats. Thus the rod end can be slipped axially into the seat of each bracket, with the pin sliding along the axial leg of the L-section notch, and then the rod can be turned to slide the pin along the angularly extending notch leg thereby locking the brackets axially to the respective rod ends. If the rod is twisted before the brackets are fixed to the wall, the rod can become detached from the brackets. Furthermore the mounting screws for the brackets remain visible and the system is clumsy to handle as it is being installed.

In German patent 2,844,191 filed 11 Oct. 1978 by M. Pawelzik et al the brackets are set up to for a tight snap fit with the respective rod ends. This system is fairly simple, but still leaves the bracket-mounting screws exposed. Furthermore the assembly is not held together solidly enough that it can be subjected to rough handling prior to installation.

OBJECTS OF THE INVENTION

It is therefore an object of the present invention to provide an improved wall-mount rod assembly for a hand shower.

Another object is the provision of such an improved wall-mount rod assembly for a hand shower which overcomes the above-given disadvantages, that is which can be assembled into a rugged easy-to-handle unit prior to assembly, that can be taken apart easily, and that forms a neat appearance with no visible screws when installed.

SUMMARY OF THE INVENTION

A rod assembly for mounting a hand shower on a wall has according to the invention an elongated rod formed at each end with a transversely throughgoing and laterally closed hole and respective holder bodies each formed with a seat in which the respective end of the rod is complementarily engageable. Each body is formed with a passage alignable with the hole of the respective rod end when same is fitted thereto. Respective screws engageable through the aligned holes and passages of the rod and bodies with the wall secure the rod to the bodies and the bodies to the wall.

This system is used with a hand shower and mounting bracket of the type described in commonly owned and copending application Ser. No. 07/909,956 filed 7 Jul. 1992. This mounting bracket for a hand shower has a support stem has a support adapted to be fixed to the wall-mount rod, a holder formed with a forked seat shaped to receive the hand-shower stem, and interengaging formations on the holder and support for pivoting of the holder on the support about a normally horizontal axis while retaining the holder and support against relative axial movement. An array of radially extending ridges formed on the support, surrounding the axis, and projecting toward the holder engage with complementary ridges formed on a flange of a retaining element rotationally coupled to the holder. A locking bolt axially fixed in the support axially presses the retaining-element ridges against the support ridges so that the holder can be pivoted about the axis on the support with elastic deformation of the flange.

Thus with this system the rod can be solidly mounted on the wall without the mounting screws being visible. In addition prior to installation the assembly is a stable rigid structure that is easy to handle. It furthermore can be disassembled fairly easily, for instance, to add a soap-dish fixture to the rod.

Furthermore according to the invention respective cover sleeves fittable over the holders are each formed with a throughgoing hole through which the respective rod end fits, and an end cap releasably secured to the cover sleeve. Each cap is provided with snap fingers releasably securing it in the respective sleeve.

In addition in accordance with this invention respective plugs engaged through the holes of the rod ends and into the respective passages of the holders each have a flange bearing on the respective rod end and formations releasably securing it in the respective holder passage. The plugs each are formed with a throughgoing hole through which the respective screw passes. The hole of each plug is laterally elongated and slot-shaped to allow some position adjustment of the end bracket on installation.

The rod according to the invention is tubular and each holder is formed adjacent the respective seat with a projection over which the respective rod end is engaged. The passages extend through the projections. Furthermore each rod end is formed diametrically opposite the respective hole with a radially throughgoing and axially outwardly open notch.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
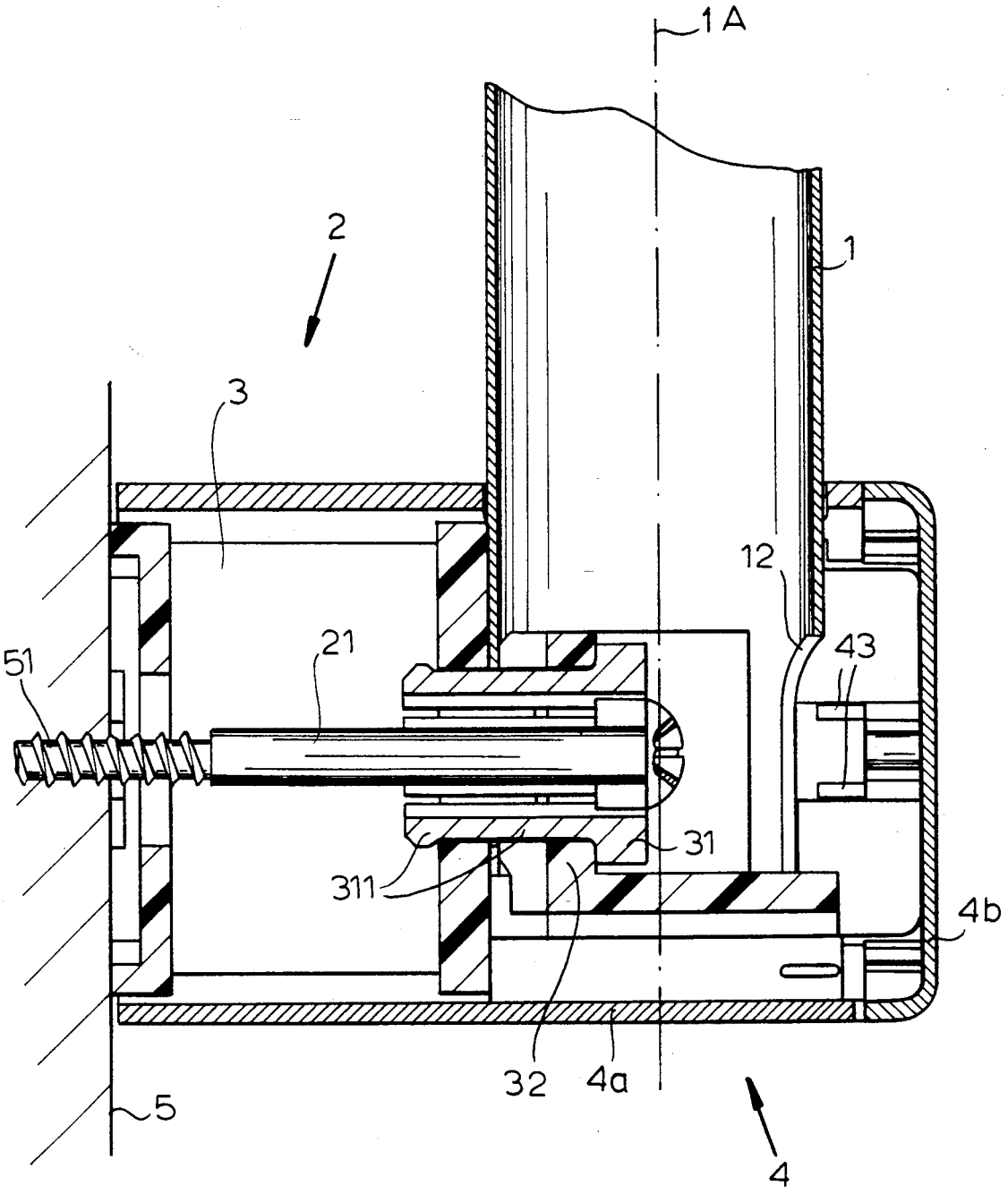
FIG. 1 is a large-scale vertical section through the end of a wall-mount rod for a hand shower according to the invention.

As seen in FIG. 1 a wall-mount rod for an unillustrated hand shower comprises a tubular rod 1 centered on an axis 1A that is normally vertical, a bracket body 3, a screw 21 securing the body 3 to a wall 5, a plug 31 clamping the rod 1 between the screw 21 and body 3, and a cover 4 comprised of a sleeve **4*a* and an end cap 4*b***.

Figure 4:
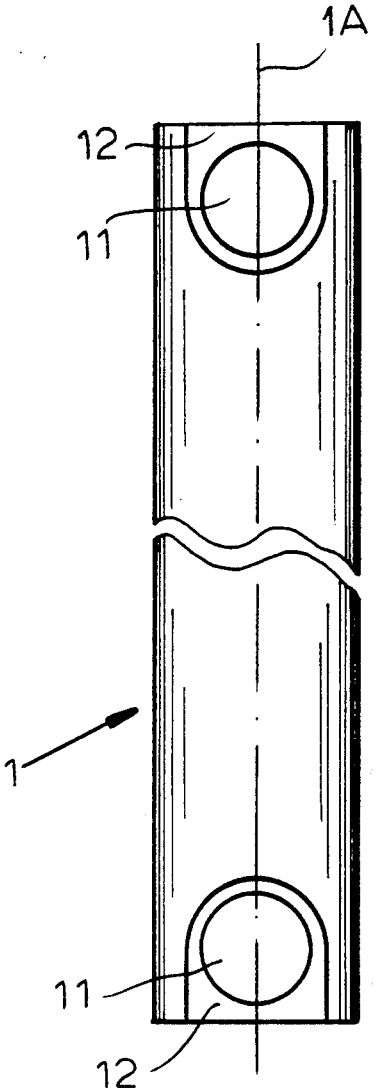
FIGS. 3 and 4 are views taken in the directions of respective arrows III and IV of FIG. 2.
Figure 2:
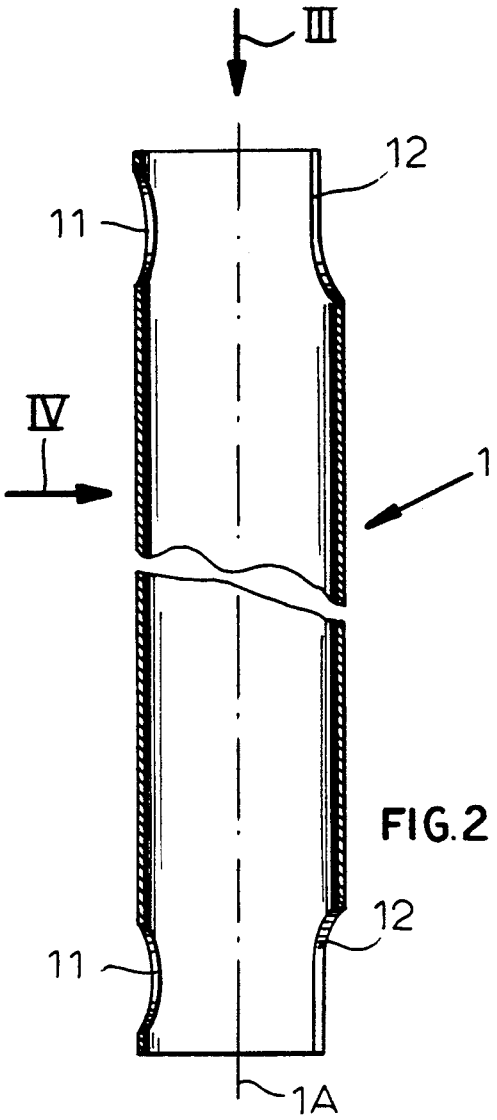
FIG. 2 is a small-scale longitudinal section through the tubular rod of the assembly of this invention.
Figure 3:
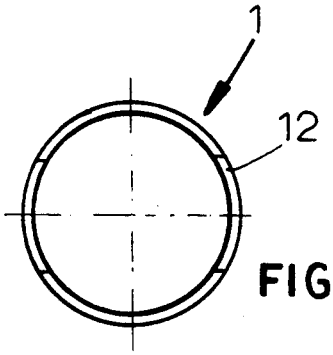
Figure 5:
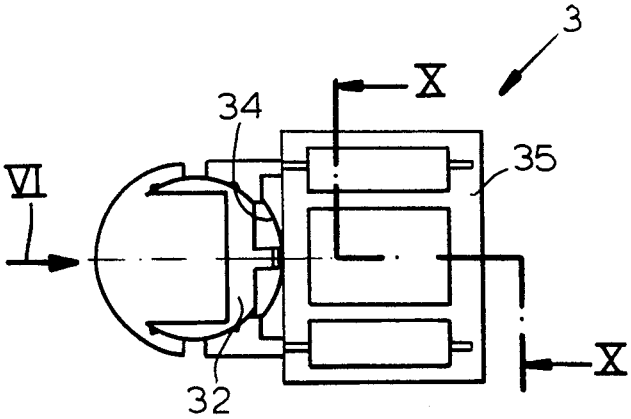
FIG. 5 is a top view of the body of the assembly of this invention.
Figure 6:
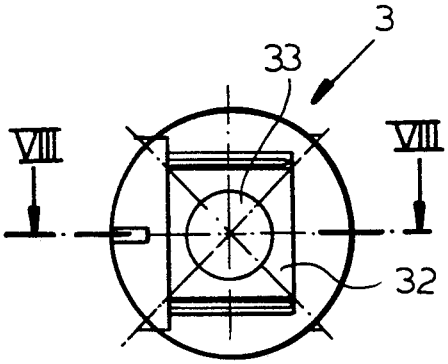
FIG. 6 is a front view taken in the direction of arrow VI of FIG. 5.
Figure 7:
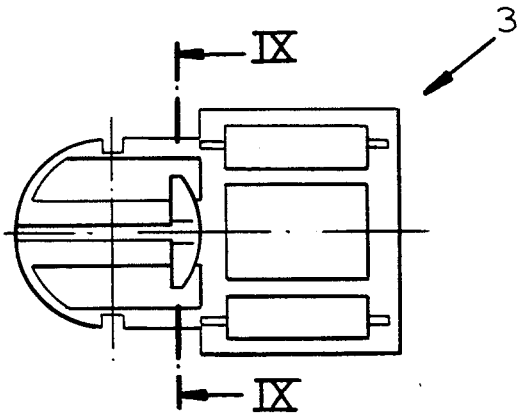
FIG. 7 is a bottom view of the body.
Figure 8:
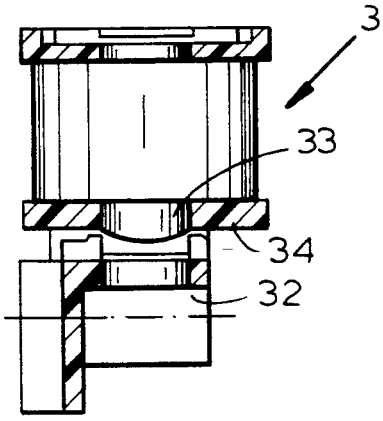
FIG. 8 is a section taken along line VIII—VIII of FIG. 6.
Figure 9:
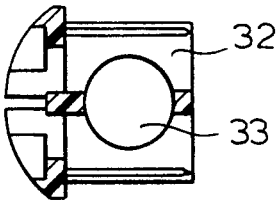
FIG. 9 is a section taken along line IX—IX of FIG. 7.
Figure 10:
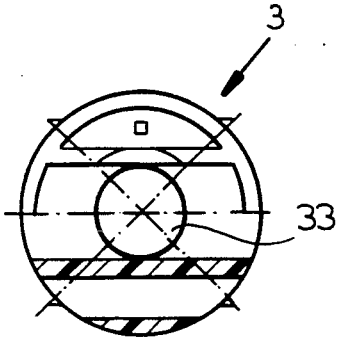
FIG. 10 is a section taken long line X—X of FIG. 5.

The rod 1 as seen in FIGS. 2 through 4 is formed at each end with a radially throughgoing and laterally closed hole 11 and diametrically across from each hole 11 with a radially throughgoing and axially outwardly open notch 12. This rod 1 is normally made of a light but durable metal and is typically chromium plated.

The body 3 as seen in FIGS. 5 through 10 has a flat end face 35 adapted to fit flatly against the wall 5, a part-cylindrical opposite face 34 forming a concave seat of the same radius of curvature as the rod 1, and a portion 32 adapted to fit into the end of the rod 1. A hole 33 is formed in the body through the projection 32 and opening at the end face 35.

Figure 11:
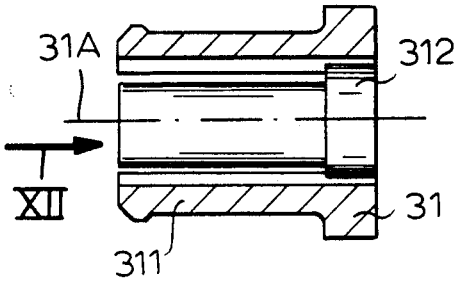
FIG. 11 is a longitudinal section through the retaining plug of the assembly.
Figure 12:
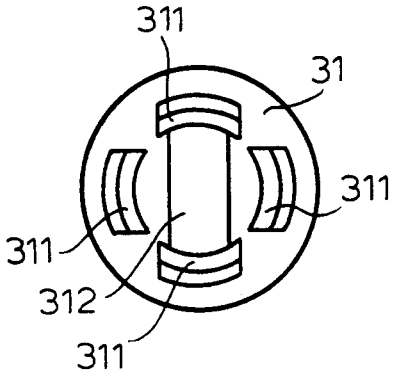
FIG. 12 is an end view taken in the direction of arrow XII of FIG. 11.

The plug 31 shown in FIGS. 11 and 12 is shaped to fit snugly in the hole 33. This plug 31 extends along and is centered on an axis 31A and has a plurality of axially extending and radially deflectable snap fingers 311 that are intended to pass through the hole 33 and snap in place behind a wall of the body 3 forming the seat 34. The plug 31 is formed with a central axially throughgoing hole or passage 312 that is transversely elongated like a slot for purposes described below. Both the plug 31 and body 3 are formed of a durable synthetic resin.

Figure 14:
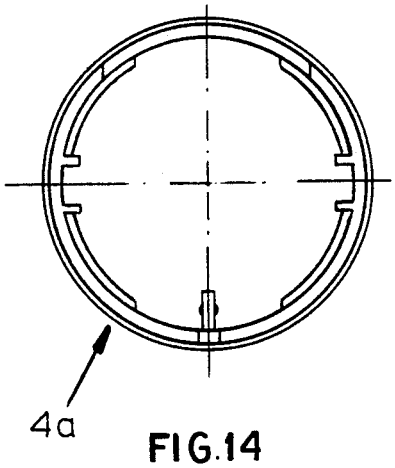
FIG. 14 is a view taken in the direction of arrow XIV of FIG. 13.
Figure 13:
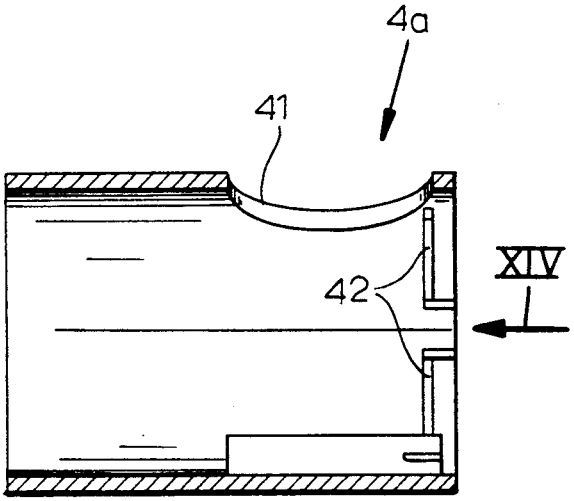
FIG. 13 is a longitudinal section through the cover sleeve of the assembly.

FIGS. 13 and 14 show how the cover sleeve **4*a* is basically cylindrically tubular and is formed adjacent one end with a single laterally throughgoing hole 41 and adjacent this one end with holding formations 42 behind which engage snap fingers 43 (see FIG. 1) on the cover cap 4*b***.

The assembly described above is put together as follows:

First of all the cover sleeve **4*a* is slipped over the body 3 to fit on the projection 32 and its hole 41 is aligned with the seat 34. Then an end of the rod 1 is poked into the hole 41, and fitted to the seat 34. The rod 1 is rotated about its axis 1A until its hole 11 is concentric with the passage 33**.

The plug 31 is then pressed though the notch 12 into the holes 11 and 33 until its spring fingers 311 snap in place. This secures the rod 1 to the body 1 and cover sleeve **4*a*** so the assembly can be manipulated without the parts becoming misaligned or falling apart.

The passage 33 is then aligned with a hole 51 in the wall 5, which hole normally is provided with some type of anchor sleeve, and the screw 21 is poked through the slot 312 into this hole 51. Rotation of the plug 31 in the hole 33 allows the assembly to be lined up with holes 51 that are not perfectly located.

The screw 21 is then tightened to clamp the rod 1 in the seat 34 by pulling the projection 32 toward it, and the end cap **4*b*** is snapped into place. This completes the assembly.

If it is necessary subsequently to disassembly the rod, for instance to mount a soap dish on it, one need merely pull off the caps **4*b* and retract the screws 21 to completely dismount the assembly. Then one of the plugs 31** can be pulled out to allow the respective rod end to be freed.

We claim:

1. A rod assembly for mounting a hand shower on a wall, the assembly comprising:

an elongated rod formed at each end with a transversely throughgoing and laterally closed hole;

respective holder bodies each formed with a seat in which the respective end of the rod is complementarily engageable, each body being formed with a passage alignable with the hole of the respective rod end when same is fitted thereto;

respective screws engageable through the aligned holes and passages of the rod and bodies with the wall to secure the rod to the bodies and the bodies to the wall; and respective plugs engaged through the holes of the rod ends and into the respective passages of the holders, each plug having a flange bearing on the respective rod end and formations releasably securing it in the respective holder passage, the plugs each being formed with a laterally elongated, slot shaped, and throughgoing hole through which the respective screw passes.

2. The wall-mount rod assembly defined in claim 1, further comprising:

respective cover sleeves fittable over the holders and each formed with a throughgoing hole through which the respective rod end fits; and respective end caps releasably secured to the cover sleeves.

3. The wall-mount rod assembly defined in claim 2 wherein each cap is provided with snap fingers releasably securing it in the respective sleeve.

4. The wall-mount rod assembly defined in claim 1 wherein the rod is tubular and each holder is formed adjacent the respective seat with a projection over which the respective rod end is engaged, the passages extending through the projections.

5. The wall-mount rod assembly defined in claim 4 wherein each rod end is formed diametrically opposite the respective hole with a radially throughgoing and axially outwardly open notch.

6. A rod assembly for mounting a hand shower on a wall, the assembly comprising:

an elongated tubular rod formed at each end with a transversely throughgoing and laterally closed hole and diametrically opposite thereto with a radially throughgoing and axially open notch;

respective holder bodies each formed with a seat in which the respective end of the rod is complementarily engageable and with a projection engageable into the respective rod end, each body being formed with a passage alignable with the hole of the respective rod end when same is fitted thereto;

respective plugs each engageable through the aligned holes of the rods ends and holders and each formed with a throughgoing hole concentric with the respective passage hole and with formations releasably retaining it in the respective passage hole; and respective screws engageable through the aligned holes and passages of the plug, rod, and bodies with the wall to secure the rod to the bodies and the bodies to the wall.

* * * * *